US010344432B2

(12) United States Patent
Lamb

(10) Patent No.: US 10,344,432 B2
(45) Date of Patent: Jul. 9, 2019

(54) ABSORBENT PAPER PRODUCT AND METHOD FOR MANUFACTURING SUCH ABSORBENT PAPER PRODUCT

(71) Applicant: SCA Hygiene Products AB, Göteborg (SE)

(72) Inventor: Hans-Jürgen Lamb, Gernsheim (DE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 16/126,528

(22) Filed: Sep. 10, 2018

(65) Prior Publication Data

US 2019/0003127 A1 Jan. 3, 2019

Related U.S. Application Data

(63) Continuation of application No. 15/300,800, filed as application No. PCT/EP2014/056595 on Apr. 2, 2014, now abandoned.

(51) Int. Cl.

| | |
|---|---|
| ***D21F 11/00*** | (2006.01) |
| ***D21F 1/00*** | (2006.01) |
| ***D21H 27/02*** | (2006.01) |

(52) U.S. Cl.

CPC ..... *D21H 27/02* (2013.01); *D21F 1/0027* (2013.01); *D21F 11/006* (2013.01)

(58) Field of Classification Search

CPC ..... D21F 11/006; D21F 1/0027; D21H 27/00; D21H 27/27; D21H 27/02; Y10S 162/902; Y10T 442/3179; Y10T 428/24455

See application file for complete search history.

(56) References Cited

U.S. PATENT DOCUMENTS 4,208,459 A * 6/1980 Becker ..... B31F 1/126 162/111
5,817,213 A * 10/1998 Ostermayer ..... D21F 1/0027 162/109

(Continued)

FOREIGN PATENT DOCUMENTS

CN 1272155 A 11/2000
CN 1354814 A 6/2002

(Continued)

OTHER PUBLICATIONS

Canadian Office Action dated Dec. 15, 2017 issued in corresponding Canadian patent application No. 2,944,675 (6 pages).

(Continued)

*Primary Examiner* — Jose A Fortuna
(74) *Attorney, Agent, or Firm* — Drinker Biddle & Reath LLP

(57) ABSTRACT

A method for manufacturing a paper product including providing a forming fabric and forming a web on the fabric. The forming fabric includes warp knuckles of directly adjacent warp yarns overlapping the cross-machine direction forming a continuous warp knuckle pattern angled to the machine and cross-machine directions. A first line connecting the centers of first two directly adjacent warp knuckles of the continuous warp knuckle pattern is angled to the machine direction at a first angle different from a second angle of a second line connecting the centers of second two directly adjacent warp knuckles of the continuous warp knuckle pattern so that a line connecting the centers of all warp knuckles forming the continuous warp knuckle pattern is non-straight. At least 50% of all the continuous warp knuckle patterns have an overlap of at least three consecutive weft yarns.

12 Claims, 4 Drawing Sheets

(56) References Cited

U.S. PATENT DOCUMENTS

| | | | | |
|---|---|---|---|---|
| 5,925,217 | A * | 7/1999 | Kaufman | D21H 27/02 162/109 |
| 6,358,594 | B1 | 3/2002 | Ampulski | |
| 6,649,026 | B2 * | 11/2003 | Lamb | D21F 1/0027 139/383 A |
| 6,708,732 | B1 | 3/2004 | Hay et al. | |
| 6,743,333 | B2 * | 6/2004 | Lamb | D21F 1/0027 162/109 |
| 2002/0056536 | A1 * | 5/2002 | Lamb | D21F 1/0027 162/100 |
| 2002/0088596 | A1 * | 7/2002 | Lamb | D21F 1/0027 162/100 |
| 2004/0035541 | A1 * | 2/2004 | Lamb | D21F 1/0027 162/348 |
| 2012/0193051 | A1 | 8/2012 | Quigley | |
| 2015/0209201 | A1 * | 7/2015 | Ashraf | A61F 13/514 604/391 |
| 2017/0211235 | A1 * | 7/2017 | Lamb | D21H 27/02 |
| 2019/0003127 | A1 * | 1/2019 | Lamb | D21H 27/02 |

FOREIGN PATENT DOCUMENTS

| | | | | |
|---|---|---|---|---|
| DE | 19732879 | A1 | 2/1999 | |
| EP | 3126571 | A1 | 2/2017 | |
| WO | WO-96/00814 | A1 | 1/1996 | |
| WO | WO-03/040470 | A1 | 5/2003 | |
| WO | WO-2012/104373 | A2 | 8/2012 | |
| WO | WO-2013/184909 | A1 | 12/2013 | |
| WO | WO-2015/149847 | A1 | 10/2015 | |
| WO | WO-2015149847 | A1 * | 10/2015 | D21H 27/02 |

OTHER PUBLICATIONS

Colombian Office Action Oficio N° 2107 dated Mar. 25, 2018 issued in corresponding Colombian patent application N°. NC2016/0003519 and its partial English-language translation thereof.

First Chinese Office Action dated Jun. 19, 2017 issued in corresponding Chinese patent application No. 201480077698.5 (12 pages) and its English-language translation thereof (13 pages).

Russian Office Action dated Jan. 18, 2018 issued in corresponding Russian patent application No. 2016142239 (8 pages) and its English-language translation thereof (6 pages).

Second Chinese Office Action dated Feb. 24, 2018 issued in corresponding Chinese patent application No. 201480077698.5 (11 pages) and its English-language translation thereof (13 pages).

Mexican Office Action No. Folio 98965 dated Nov. 27, 2018 issued in Mexican patent application No. MX/a/2016/012842 (4 pages) and its partial English-language translation thereof (3 pages).

Canadian Office Action dated Dec. 7, 2018 issued in Canadian patent application No. 2,944,675 (5 pages).

* cited by examiner

ABSORBENT PAPER PRODUCT AND METHOD FOR MANUFACTURING SUCH ABSORBENT PAPER PRODUCT

CROSS-REFERENCE TO PRIOR APPLICATION

This application is a continuation application of prior U.S. patent application Ser. No. 15/300,800, filed Sep. 30, 2016, now abandoned which is the National Stage Application of PCT International Application No. PCT/EP2014/056595 filed Apr. 2, 2014. The contents of each of these applications are incorporated herein in their entirety.

TECHNICAL FIELD

The present disclosure relates to the manufacture of a paper product, particularly an absorbent paper product, such as a hygiene or wiping product. In general, the disclosure relates to structuring a fibrous web, constituting a part of the paper product, by means of a fabric or wire used in the papermaking process (the terms "wire" and "fabric" are used synonymously throughout the application).

The fibrous web may be made of tissue paper or nonwoven. Fibrous webs of the same or a different material may be combined in the final paper product.

A tissue paper is defined as a soft absorbent paper having a low basis weight. One generally selects a basis weight of 8 to 40 g/m$^2$, especially 10 to 25 g/m$^2$ per ply. The total basis weight of multiple-ply tissue products can be equal to a maximum of 120 g/m$^2$, or to a maximum of 100 g/m$^2$, or to a maximum of 55 g/m$^2$. Its density is typically below 0.6 g/cm$^3$, below 0.30 g/cm$^3$, or between 0.08 and 0.20 g/cm$^3$.

The production of tissue is distinguished from general paper production by its extremely low basis weight and its much higher tensile energy absorption index (see DIN EN 12625-4 and DIN EN 12625-5). Paper and tissue paper also differ in general with regard to the modulus of elasticity that characterizes the stress-strain properties of these products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than a non-creped paper.

Moist tissue paper webs are usually dried by the so-called yankee drying, the through-air drying (TAD) or the impulse drying method.

The fibers contained in the tissue paper are mainly cellulosic fibers, such as pulp fibers from chemical pulp (e.g. Kraft sulfite or sulfate pulps), mechanical pulp (e.g. ground wood), thermo mechanical pulp, chemo-mechanical pulp and/or chemo-thermo mechanical pulp (CTMP). Pulps derived from both deciduous (hardwood) and coniferous (softwood) can be used. The fibers may also be or include recycled fibers, which may contain any or all of the above categories. The fibers can be treated with additives—such as fillers, softeners, such as quaternary ammonium compounds and binders, such as conventional dry-strength agents or wet-strength agents used to facilitate the original paper making or to adjust the properties thereof. The tissue paper may also contain other types of fibers, e.g. regenerated cellulosic fibers or annual plant fibers such as sisal, hemp, bast, flax, leave, grass, straw, seed, cotton or bamboo fibers, or synthetic fibers enhancing, for instance, strength, absorption, smoothness or softness of the paper.

If tissue paper is to be made out of pulp, the process essentially includes a forming that includes a box and a forming wire ("fabric") portion, and a drying portion (such as through-air drying, impulse drying, drying by pressure and/or conventional drying on a yankee cylinder). The production process also usually includes the crepe process essential for tissues and, finally, typically a monitoring and winding area.

Paper can be formed by placing the fibers, in an oriented or random manner, on one or between two (Twin-wire) continuously revolving forming wires of a papermaking machine while simultaneously removing the main quantity of water of dilution until dry-solids contents of usually between 12 and 40% are obtained.

Drying the formed primary fibrous web occurs in one or more steps by mechanical and thermal means until a final dry-solids content of usually about 93 to 97% has been reached. In case of tissue making, this stage is followed by the crepe process which crucially influences the properties of the finished tissue product in conventional processes and leads to cross-machine direction wrinkles in the fibrous web. The conventional dry crepe process involves creping on a usually 4.0 to 6.5 m diameter drying cylinder, the so-called yankee cylinder, by means of a crepe doctor with the aforementioned final dry-solids content of the raw tissue paper. Wet creping can be used as well, if lower demands are made of the tissue quality. The creped, finally dry raw tissue paper, the so-called base tissue (in the following called "fibrous web"), is then available for further processing to the final paper product.

Instead of the conventional tissue making process described above, the use of a modified technique is possible in which an improvement in specific volume is achieved by a special kind of drying which leads to an improvement in the bulk softness of the tissue paper. This process, which exists in a variety of subtypes, is termed the TAD (Through-Air Drying) technique. It is characterized by the fact that the "primary" fibrous web that leaves the forming and sheet making stage is pre-dried to a dry-solids content of about 80% before final contact drying on the yankee cylinder by blowing hot air through the fibrous web. The fibrous web is supported by an air-permeable fabric, wire or belt (in the following "TAD-fabric") and during its transport is guided over the surface of an air-permeable rotating cylinder drum, the so-called TAD-cylinder.

Structuring the fabrics, be it in the forming portion or the drying portion makes it possible to produce any pattern of compressed zones broken up by deformation in the moist state, also named moulding, resulting in increased mean specific volumes and consequently leading to an increase of bulk softness without decisively decreasing the strength of the fibrous web.

The term non-woven (ISO 9092, DIN EN 29092) is applied to a wide range of products which, in terms of their properties, are located between those of paper (cf. DIN 6730, May 1996) and cardboard (DIN 6730) on the one hand, and textiles on the other hand. As regards non-woven a large number of extremely varied production processes are used, such as the air-laid and spun-laced techniques as well as wet-laid techniques. The non-woven includes mats, non-woven fabrics and finished products made thereof. Non-wovens may also be called textile-like composite materials, which represent flexible porous fabrics that are not produced by the classic methods of weaving warp and weft or by looping. In fact, non-wovens are produced by intertwining, cohesive or adhesive bonding of fibers, or a combination thereof. The non-woven material can be formed of natural fibers, such as cellulose or cotton fibers, but can also include synthetic fibers, such as polyethylene (PE), polypropylene (PP), polyurethane (PU), polyester, polyamide (PA) such as nylon or regenerated cellulose, or a mix of different fibers. The fibers may, for example, be present in the form of endless fibers of pre-fabricated fibers of a finite length, as synthetic fibers produced in situ, or in the form of staple fibers. The nonwovens may include mixtures of synthetic and cellulose fibrous material, e.g. natural vegetable fibers (see ISO 9092, DIN EN 29092).

The fibrous web may be converted to the final paper product, such as a hygiene or wiping product in many ways, for example, by embossing, printing and/or laminating it into a multi-ply product including a plurality of fibrous webs, rolled or folded.

Hygiene or wiping products primarily include all kinds of dry-creped tissue paper, wet-creped paper, TAD-paper (Through-Air Drying) and cellulose or pulp-wadding or all kinds of non-wovens, or combinations, laminates or mixtures thereof. Typical properties of these hygiene and wiping products include the reliability to absorb tensile stress energy, their drapability, good textile-like flexibility, properties which are frequently referred to as bulk softness, a higher surface softness and a high specific volume with a perceptible thickness. A liquid absorbency as high as possible and, depending on the application, a suitable wet and dry strength as well as an appealable visual appearance of the outer product's surface are desired. These properties, among others, allow these hygiene and wiping products to be used, for example, as cleaning wipes such as paper or non-woven wipes, windscreen cleaning wipes, industrial wipes, kitchen paper or the like; as sanitary products such as for example bathroom tissue, tissue paper or non-woven handkerchiefs, household towels, towels and the like; as cosmetic wipes such as for example facials and as serviettes or napkins, just to mention some of the products that can be used. Furthermore, the hygiene and wiping products can be dry, moist, wet, printed or pretreated in any manner. In addition, the hygiene and wiping products may be folded, interleaved or individually placed, stacked or rolled, connected or not, in any suitable manner.

Due to the above description, the products can be used for personal and household use as well as commercial and industrial use. They are adapted to absorb fluids, remove dust, for decorative purposes, for wrapping or even just as supporting material, as is common for example in medical practices or in hospitals.

To produce multi-ply tissue paper products, such as handkerchiefs, bathroom paper, towels or household towels, an intermediate step often occurs with so-called doubling in which the base tissue in the desired number of plies of a finished product is usually gathered on a common multi-ply mother reel. It is understood that (multi-ply) tissue paper products of different (multi-ply) mother reels can be further combined in subsequent converting steps.

In the final hygiene or wiping product one or more of the fibrous webs may be combined. Thereby webs of the same material, for example tissue paper or nonwoven may be combined or webs of different materials may be combined thereby forming hybrid products. In the latter a tissue paper may be combined with a nonwoven. In addition, one ply in itself may be a hybrid in regard that different types of fibers (tissue cellulosic fibers and non-woven fibers) are used in one and the same ply. A hybrid product may also be obtained in that tissue paper plies which are manufactured by different methods (for example TAD and conventional) may be combined.

BACKGROUND ART

U.S. Pat. No. 5,925,217 A for example discloses a through-air drying fabric having a plurality of machine direction oriented warp knuckles formed by warp yarns of the fabric and floating over the weft yarns of the fabric. These warp knuckles form compressed areas in the fibrous web dried on such a fabric with a machine direction orientation. Warp knuckles of directly adjacent warp yarns overlap in a cross-machine direction, but the warp yarns are arranged so that a line connecting the centers of all warp knuckles is straight. Thereby the paper or more particularly the fibrous web receives a uniform pattern with a plurality of strictly diagonally arranged linear compressed areas in the fibrous web. This relatively uniform and strict geometric arrangement is not capable of providing the fibrous web as such with a unique patterning which would make the paper product clearly distinguishable from other products. In addition, this strict uniform and linear patterning gives the fibrous web a relatively stiff appearance. A similar disclosure may also be found in WO 2012/104373 A. In order to disintegrate the strict diagonal structure of the compressed areas, the fabric disclosed in WO 2012/104373 A arranges a weft knuckle between pairs of warp knuckles. However, also this kind of fabric provides a relatively uniform and strict pattern repeat with straight linear rows of compressed areas, however, alternately arranged in both machine and cross-machine direction. Also this pattern is perceived as background pattern not providing the fibrous web with a distinct appearance. Additionally, also this kind of patterning gives the fibrous web a relatively stiff outer appearance which is perceived negative by the consumer.

To cope with these problems, it is common to convert the fibrous web to final products such as hygiene or wiping products by use of embossing and/or printing. It is possible to emboss or print a random pattern which imparts a distinct pattern enabling a distinction of the product from other products as well as give the product a bulky and soft outer appearance.

On the other hand, the converting processes add on the manufacturing costs and, therefore, increase the price of the products. This is particularly disadvantageous when considering products of the lower price segment, such as one ply paper products including only one fibrous web or ply, respectively.

In these kinds of products, it would be highly desirable to impart a pattern to the fibrous web already during the papermaking process so that one may even dispense the embossing and/or printing step to arrive at the final product.

SUMMARY

Taking the aforesaid into account, it desired to provide a paper product as well as a method for manufacturing such a paper product, which has a distinct pattern imparted during the papermaking process and visually supporting the soft and bulky properties of the paper product. It is also desired for the provision of such pattern with a less harmonic and less strict geometric appearance as compared to a prior art pattern to thereby increase the soft and absorbent perception of a user without impairing the absorbency, wet strength, bulk, etc.

One disclosed aspect is the use of a fabric in the paper-making process (in the forming or in the drying portion), be it the forming fabric or any drying fabric, particularly a through-air drying fabric. Such fabric is formed by warp yarns extending in the machine direction and weft yarns extending in the cross-machine direction. As used herein, the "machine direction" is that direction in which the fabric moves during the paper making process. As used herein, the "cross machine direction" is the direction perpendicular to the machine direction. The fabric has a pattern repeat. As used herein, "a pattern repeat" is a region repeated on the web or fabric, each region having the same configuration. As used herein, the term "pattern repeat" may also be defined as the interval at which a pattern is duplicated or repeated on a piece of fabric or web. A plurality of longitudinal warp knuckles is formed in the pattern repeat by warp yarns floating over weft yarns, or floating over at least two of weft yarns. The warp knuckles are machine direction oriented, i.e. the longitudinal extension of the warp knuckles is substantially parallel to the machine direction. As used herein, "substantially" means that the longitudinal extension of the warp knuckles is angled to the machine direction not more than 45°, not more than 30°, not more than 20°, or not more than 10°. The same applies to the extension of the yarns itself. The warp yarns are machine direction oriented and their maximum deviation from the machine direction may be up to 45°, up to 30°, up to 20°, or up to 10°. The same applies to the weft yarns which are cross-machine direction oriented. The warp knuckles are arranged so that warp knuckles of directly adjacent warp yarns overlap in a cross machine direction. As used herein, the term "directly adjacent" means that no other warp yarn is disposed between the two warp yarns forming the warp knuckles as seen in a plan view. As used herein, the term "overlap" means that adjacent warp knuckles are offset relative to each other in the machine direction. A group consisting of a plurality of these directly adjacent warp knuckles forms a continuous warp knuckle (compression) pattern. The continuous warp knuckle pattern extends diagonally (angled) to the machine direction.

According to one embodiment, some of directly adjacent warp knuckles within said group may have a different float length in the machine direction. According to another embodiment, the float length may be the same, but some of directly adjacent warp knuckles within said group are differently displaced to each other in the machine direction. Certainly, the two aspects above may as well be combined.

In particular embodiments, a line connecting the centers of a first pair of directly adjacent warp knuckles of said group and a line connecting the centers of another pair of warp knuckles of directly adjacent warp yarns of said group is differently oriented as seen in the plan view, i.e. one line is angled to the machine direction differently than the other line. In this context, the two pairs may be constituted by first to fourth warp knuckles but also by first to third warp knuckles, wherein the second warp knuckle is part of both the first and the second pair and disposed between the first and the third warp knuckle as seen in the cross-machine direction. It is as well conceivable that the line passes through the centers of more than two directly adjacent warp knuckles without changing its orientation.

In particular embodiments, the line connecting all centers of a plurality of directly adjacent warp knuckles overlapping in the cross-machine direction is non-straight. These warp knuckles form said continuous warp knuckle (compression) pattern within the pattern repeat over part of or the entire surface of the fabric. Thereby one may achieve that the outer contour of the continuous warp knuckle pattern is non-straight.

The warp knuckles of the fabric form compressed areas in the fibrous web during manufacture. As the compressed areas correspond to the warp knuckles, the fibrous web has a plurality of longitudinal machine direction oriented compressed areas. A plurality of directly adjacent compressed areas with no compressed area between them in the cross-machine direction form a continuous compressed pattern over part of or the entire surface of the fibrous web thereby defining a group of compressed areas. The outer contour of this compressed pattern is non-straight, or, for example, wavy or curved. Thereby, one can give the fibrous web and, hence, the paper product a distinct patterning which makes the product distinguishable from other products without the need of a subsequent embossing or printing. At the same time, this non-straight outer contour of the compressed pattern supports the impression of a bulky and soft paper product which is considered advantageous, particularly when considering hygiene and wiping products. The latter is particularly achieved by breaking up the strict geometric pattern of the prior art.

A paper product according to particular embodiments includes a fibrous web manufactured in a paper making machine including a fabric, particularly a forming fabric or a drying fabric, or, for example, a through-air drying fabric. The web has a first and an opposite second side, a machine direction and a cross-machine direction. One of the two sides comes in contact with the fabric during the manufacturing process. The side of the fabric coming into contact with the fibrous web is called the paper side and the side of the fibrous web which comes into contact with the fabric is called the fabric side. The opposite side of the fabric, which does not come into contact with the fibrous web, is called the wear side. The terminology "machine direction" and "cross-machine direction", as used herein, has already been defined previously. At least one of the first and second sides of the web, or the fabric side, has in a pattern repeat a number of longitudinal, machine direction oriented compressed areas with a first density of fibers and a number of machine direction oriented bulky areas with a second density of fibers lower than the first density. The compressed areas may on one side of the paper, particularly on the fabric side of the paper, appear as recesses, whereas the compressed areas on the opposite side of the paper form ridges. To the contrary, the bulky areas, in which the fiber density is lower than in the compressed areas or where the paper is less compressed in these areas, are on the fabric side of the paper constituted by ridges, whereas they are constituted by recesses on the opposite side of the paper. The compressed areas correspond to machine direction oriented warp knuckles of warp yarns of the fabric floating over weft yarns of the fabric as described earlier. Directly adjacent compressed areas corresponding to warp knuckles of directly adjacent warp yarns overlap in the cross-machine direction, a group of directly adjacent compressed areas forming a continuous compressed pattern angled to the machine and cross-machine directions. As used herein, the term "continuous compressed pattern" means a group of directly adjacent compressed areas which are arranged in a row which diagonally extends over the surface of the first and/or second side of the fibrous web relative to the machine and the cross-machine directions. The continuous compressed pattern may be limited to a pattern repeat or may extend over more than one pattern repeat or over the entire paper. In the latter case, a continuous compressed pattern of one pattern repeat is connected to another continuous compressed pattern of another pattern repeat. Thereby, a continuous pattern of a plurality of machine direction oriented compressed areas corresponding to warp knuckles of directly adjacent warp yarns may be formed over the entire surface of the paper. According to this aspect, a first line connecting the center of first two directly adjacent compressed areas of the continuous compressed pattern is angled to the machine direction at a first angle different from a second angle of a second line connecting the center of second two directly adjacent compressed areas of the continuous compressed pattern. Thus, a line connecting the centers of all compressed areas forming the continuous compressed pattern is non-straight. The center is defined as that point which is situated at half length and half width of each compressed area. By these measures, it is possible to disintegrate the strict straight and geometric pattern of the prior art and provide the fibrous web and, hence, the paper product with a distinct patterning enabling a consumer to distinguish the paper product from other products. In addition, the non-straight continuous compressed pattern gives the consumer the feeling of a soft and bulky paper, which is perceived advantageous, particularly when used as absorbent paper, particularly for wiping and hygiene purposes. At the same time, this patterning does not alter the physical properties of the paper such as wet strength, softness, etc. In addition, because this pattern is imparted during the paper making process rather than later converting, this pattern is also maintained when the paper product gets wet. To the contrary, a pattern imparted to a paper by means of embossing is dissolved when wetting the paper as the densified fibers dissolve. This does not occur when patterning the fibrous web during the paper making process that is in the wet state of the paper. Further, by means of this patterning, it is conceivable to even omit later embossing without impairing the physical and esthetic characteristics of a paper product.

In particular embodiments, the outer contour of the continuous compressed pattern is wavy or curved. A wavy or curved form like a sine or arbitrary curve provides for a harmonical outer appearance which further enhances the consumer's perception of a bulky and soft product.

In this connection, the line connecting the centers of all compressed areas can have at least two turning points. The more turning points the line has, the longer is the diagonal (to the machine and cross-machine direction) extension of the compressed pattern.

According to one embodiment, the lines connecting the centers of all compressed areas of the continuous compressed patterns adjacent in the cross-machine direction are non-parallel or parallel. In a certain embodiment, the lines are congruent. However, they may be arranged parallel so that the distance in the cross-machine direction between two directly adjacent lines, that is a first group of directly adjacent warp knuckles and a second group of directly adjacent warp knuckles is the same. However, in order to increase the distinctiveness of the pattern, the two lines, which are congruent, can be non-parallel, that is the distance in the cross-machine direction between a first line and a second line differs along the machine direction. Or to use the previous wording, the distance between a first group of directly adjacent warp knuckles and a second group of directly adjacent warp knuckles differs in the machine direction.

The more lines with a different angle relative to the machine direction are provided in a single group of a plurality of directly adjacent compressed areas, the lower the amplitude of the line. Thus, according to one embodiment, a third line connecting the center of third two adjacent compressed areas of the continuous compressed pattern is angled to the machine direction at a third angle different from the first and second angles. Certainly, there may be more than three lines with different angles. In addition, it is as well conceivable that there are lines of different pairs of directly adjacent compressed areas, which have the same angle as long as there is another pair of directly adjacent compressed areas, the line of which has a different angle.

Adjacent continuous compressed patterns may be formed in the cross-machine direction and two adjacent continuous compressed patterns may border a discontinuous bulky pattern between them.

According to one embodiment, the fibrous web is subject to a creping process as described in the introductory portion, whereby cross-machine wrinkles are formed in the fibrous web. The cross machine wrinkles from creping are delimited by compressed areas of adjacent continuous compressed patterns. Because the line connecting the centers of all compressed areas of a continuous compressed pattern is non-straight, the wrinkles from creping are different in a cross-machine direction length. This further disintegrates the visual geometric strictness of the pattern on the first and/or second side of the fibrous web additionally improving the soft and bulky perception.

According to another aspect, a method for manufacturing a paper product as described above is disclosed, wherein a fibrous web is formed on a forming fabric or dried on a drying fabric, or, for example, a through-air drying fabric, the fabric having a plurality of machine direction oriented warp knuckles formed by warp yarns of the fabric floating over weft yarns of the fabric, wherein warp knuckles overlap in the cross-machine direction forming a continuous pattern angled to the machine and cross-machine directions of directly adjacent warp yarns. A first line connecting the center of first two directly adjacent warp knuckles of the continuous pattern is angled to the machine direction at a first angle different from a second angle of a second line connecting the center of second two directly adjacent warp knuckles of the continuous pattern so that a line connecting the centers of all warp knuckles forming the continuous pattern is non-straight, wherein the warp knuckles form compressed areas in the web at which the fiber density is higher than in other areas. In order to avoid repetition, reference is made to the previous passages.

According to one embodiment, the warp knuckles of the fabric have a float length of at least 4, at least 5, or at least 6. Thereby, it is ensured that the warp knuckles impart a certain visible pattern to the fibrous web in that the compressed areas of the fibrous web will have a length in the machine direction which is distinct from warp knuckles formed by floating over only one weft yarn or at most two weft yarns.

In order to give emphasis on the compressed areas formed by the warp knuckles, the fabric can have only weft knuckles with a float length of less than 4, less than 3, or less than 2.

As explained previously, to achieve a non-straight line connecting the centers of all directly adjacent warp knuckles forming a continuous compressed pattern on the fibrous web, the float length of the first two adjacent warp knuckles and/or the second two adjacent warp knuckles may be the same or different. If the float length is the same and in order to obtain lines with a different angle, the warp knuckles are displaced differently relative to each other in the machine direction. If the floating length is different, the center of the warp knuckles is automatically displaced in the machine direction.

Furthermore and in order to enable a harmonic appearance of the paper product, the average float length of all warp knuckles of a pattern repeat forming the continuous compressed pattern can be 4 to 8, 5 to 7, or 5.5 to 6.5. Thereby, a distinct and emphasized pattern may be achieved without the several compressed areas becoming too non-uniform decreasing the perception of the pattern as such. The float length is defined as the number of adjacent weft yarns the warp yarns pass over when forming the warp knuckles. The average float length is calculated by summing up the float length of all warp knuckles within the pattern repeat forming the continuous compressed pattern divided by the number of warp knuckles within the pattern repeat forming the continuous compressed pattern.

This is further or alternatively enhanced in that at least 50 percent of the warp knuckles of a pattern repeat forming the continuous compressed pattern have a float length difference of not more than 25 percent, 20 percent, or 15 percent of the average float length (see above).

Another aspect relates to the use of a fabric in the manufacture of a paper product, the fabric including a plurality of machine direction oriented warp knuckles formed by warp yarns of the fabric floating over weft yarns of the fabric, wherein warp knuckles of directly adjacent warp yarns overlap in the cross-machine direction forming a continuous pattern angled to the machine and cross-machine directions. A first line connecting the center of first two directly adjacent warp knuckles of the continuous pattern is angled to the machine direction at a first angle different from a second angle of a second line connecting the center of second two directly adjacent warp knuckles of the continuous pattern so that a line connecting the centers of all warp knuckles forming the continuous pattern is non-straight, wherein the warp knuckles form compressed areas in the fibrous web at which the fiber density is higher than in other areas. In order to avoid repetition, reference is made to the above passages relating to the paper product and the method.

According to an even further aspect, a paper product includes a fibrous web manufactured in a paper making machine including a fabric, particularly a forming fabric or a drying fabric, the fibrous web having a first and an opposite second side, a machine direction (MD) and a cross-machine direction (CD), wherein at least one of the first and second sides of the web has in a pattern repeat, a number of longitudinal, machine direction oriented compressed areas with a first density of fibers and a number of machine direction oriented bulky areas with a second density of fibers lower than the first density, wherein the compressed areas correspond to machine direction oriented warp knuckles (21-31) of warp yarns (10) of the fabric floating over weft yarns (11) of the fabric, and the bulky areas correspond to valleys recessed relative to warp knuckles, wherein a continuous compressed pattern is formed by a plurality of compressed areas which are arranged directly adjacent in cross-machine direction and at least a majority of them being offset relative to each other in the machine direction, wherein the continuous compressed pattern has at least one first group of compressed areas and at least one second group of compressed areas, the at least one first group being formed by a first number of directly adjacent compressed areas and the at least one second group being formed by a second number of directly adjacent compressed areas, the second number being smaller than the first number and the average offset of the compressed areas in the at least one first group is smaller than the average offset of the compressed areas in the at least one second group. A fabric for manufacturing such a paper product, or its corresponding use, includes a first side and a second side opposing the first side, a machine direction and a cross-machine direction, a plurality of machine direction (warp) yarns interweaving with a plurality of cross-machine direction (weft) yarns to form a pattern repeat at the first side, per pattern repeat each of the warp yarns forming several MD-floats consecutive in machine direction, each MD-float being formed by passing of a warp yarn on the first side over a plurality of consecutive weft yarns, the pattern repeat includes a plurality of elevated compression patterns (or regions or areas) separated by a plurality of valleys recessed relative to the compression patterns, wherein each compression pattern is formed by a plurality of MD floats (warp knuckles) which are directly adjacently arranged in cross-machine direction and at least a majority of them being offset relative to each other in the machine direction or overlapping in the cross machine direction, wherein at least one compression pattern has at least one first group of warp knuckles and at least one second group of warp knuckles, the at least one first group being formed by a first number of directly adjacent warp knuckles and the at least one second group being formed by a second number of directly adjacent warp knuckles, the second number being smaller than the first number and the average offset (or overlap) of the warp knuckles in the at least one first group is smaller than the average offset (or overlap) of the warp knuckles in the at least one second group. This as well enables a disintegration of the usually strict geometric patterning and leads to a less harmonic visual appearance with the benefit that the product is perceived softer and more bulky. At the same time absorbency, tear resistance and crepability may be maintained.

In particular embodiments, the paper product has a continuous compressed pattern within a pattern repeat that is formed by at least 10 directly adjacent compressed areas (warp knuckles). In certain embodiments, all compressed areas which form a continuous compressed pattern are offset relative to each other in machine direction or overlap in the cross machine direction.

According to an embodiment, each continuous compressed pattern includes at least one first and second group. In a particular embodiment, the first and second groups are arranged alternatingly.

The continuous compressed patterns may, in one embodiment, be adjacently arranged in machine direction and/or cross-machine direction.

According to one aspect, each of the first groups is formed by at least four directly adjacent compressed areas, or at least six directly adjacent compressed areas and/or each of the second groups is formed by a maximum of six adjacent compressed areas, or by a maximum of four adjacent compressed areas.

According to an embodiment, the first groups are formed by first compressed areas and the second groups are formed by second compressed areas, wherein the first compressed areas have a first length and the second compressed areas have a second length. The first length may be different to the second length. In this instance, the first length is larger or smaller than the second length.

The average offset (overlap) of the compressed areas in the first group may be between 0.5 and 2 and that of the compressed areas in the second group may be between 1.2 and 4. The offset or overlap is calculated in view of the squares shown in the accompanying drawings. If the squares at one end of the adjacent compressed areas (warp knuckles) are aligned as seen in the cross machine direction, there is no offset or overlap. If the squares are for example displaced by half of their side length, the offset (overlap) is 0.5, etc. As such directly adjacent compressed areas may overlap each other in cross machine direction by at least half of their longitudinal length. The average offset is then calculated by summing at all offsets between adjacent compressed areas forming the respective group divided by the number of offsets in the group.

In an embodiment, at least 50% of all adjacent compressed areas have an overlap of at least three consecutive weft yarns.

In an embodiment, the contact area of the warp knuckles formed by the first groups differs from the contact area of the warp knuckles formed by the second groups by a maximum of 30%, a maximum of 20% in regard to the total contact area of the fabric on the first side. The contact area is defined as that area of the warp knuckles that comes into contact with a yankee cylinder.

Further, the pattern repeat includes at least one warp yarn forming a plurality of consecutive first warp knuckles and at least another warp yarn forming a plurality of consecutive second warp knuckles.

In an embodiment, (see FIG. 1) the pattern repeat includes a plurality of first machine direction yarns, each of the first machine direction yarns forming a plurality of consecutive first warp knuckles and, for example, a plurality of second machine direction yarns, each of the second machine direction yarns forming a plurality of consecutive second warp knuckles and, for example, a plurality of third machine direction yarns, each of the third machine direction yarns forming at least one first and at least one consecutive second warp knuckle.

Consecutive warp knuckles of each of the warp yarns may be separated by a separation area (bulky area), the separation area being formed by at least one float of the warp yarn on the second side over at least a weft yarn.

The pattern repeat may include a plurality of separation areas, at least some of them being formed by one of a plain weave sequence of a warp yarn with at least three consecutive weft yarns and a float (knuckle) of a warp yarn on the second side over at least two consecutive weft yarns.

The separation areas of all warp yarns together contribute to form the recessed valleys (bulky areas).

In an embodiment, the continuous compressed pattern has a major axis and a minor axis, wherein the major axis is oriented at an angle relative to the machine direction. The alignment angle can be at least 20° relative to the machine direction, or not more than 80° relative to the machine direction. In certain embodiments, all continuous compressed patterns are arranged along a plurality of parallel rows oriented at the alignment angle. That is the major axis of all continuous compressed patterns is parallel. In an embodiment, valleys (bulky areas) describe a plurality of wavy lines running along parallel rows oriented at the alignment angle. Also or alternatively, the outer contour of the continuous compressed patterns can be wavy.

According to one embodiment, the fabric or the web has, in the machine direction, between 1 and 10, 2 and 8, or 3 to 6 continuous compressed patterns per pattern repeat.

According to an embodiment, each of the bulky areas (separation areas) has a center of the area, wherein a first center line connecting the centers of first two directly adjacent bulky areas is angled to the machine direction at a first separation angle and a second center line connecting the centers of a second of two directly adjacent separation areas is angled to the machine direction at a second separation angle different to the first separation angle. In a particular embodiment, a line connecting the centers of more than five adjacent bulky areas is a wavy line.

According to one embodiment, the fabric is a single layer fabric.

Further, the first side may provide a paper contacting surface and the second side a machine contacting surface.

According to an even further embodiment (see FIG. 1), a paper product includes a fibrous web manufactured in a paper making machine comprising a fabric, particularly a forming fabric or a drying fabric, the fibrous web having a first and an opposite second side, a machine direction (MD) and a cross-machine direction (CD), wherein at least one of the first and second sides of the web has in a pattern repeat, a number of longitudinal, machine direction oriented compressed areas with a first density of fibers and a number of machine direction oriented bulky areas with a second density of fibers lower than the first density, wherein the compressed areas correspond to machine direction oriented warp knuckles (21-31) of warp yarns (10) of the fabric floating over weft yarns (11) of the fabric, and the bulky areas correspond to valleys recessed relative to warp knuckles, wherein a continuous compressed pattern is formed by a plurality of compressed areas which are arranged directly adjacent in cross-machine direction, wherein the pattern repeat includes in the machine direction a row of a plurality of first compressed areas and a row of a plurality of second compressed areas, the first compressed areas of the row being separated in the machine direction by first bulky separation areas, the second compressed areas of the row being separated in the machine by second bulky separation areas, the first compressed areas having a length in the machine direction being longer than the length of the second compressed areas, the first bulky separation areas being shorter in machine direction than the second bulky separation areas. The corresponding fabric or the fabric for use in the manufacture of a paper product includes a first side and a second side opposing the first side, a machine direction and a cross-machine direction, a plurality of warp yarns interweaving with a plurality of weft yarns to form a pattern repeat at the first side, per pattern repeat each of the warp yarns forming several warp knuckles consecutive in machine direction and separated from each other by separation areas, each warp knuckle being formed by passing of a warp yarn on the first side over a plurality of consecutive weft yarns, each separation area being formed by at least one float of the warp yarn on the second side over at least one weft yarn, wherein the pattern repeat includes a plurality of first warp yarns and a plurality of second warp yarns, the first warp yarns forming first warp knuckles separated by first separation areas, the second warp yarns forming second warp knuckles separated by second separation areas, the first warp knuckles have a first float length being longer in machine direction than the float length of the second warp knuckles, the first separation areas being shorter in machine direction than the second separation areas.

In an embodiment, the first warp yarns form a plurality of groups of adjacently arranged first warp knuckles per pattern repeat and the second warp yarns form a plurality of groups of adjacently arranged second warp knuckles per pattern repeat. According to an embodiment, the first groups and the second groups are alternatingly arranged in cross machine direction and offset relative to each other in machine direction.

Adjacent first warp knuckles in the first groups are offset relative to each other in machine direction and/or adjacent second warp knuckles in the second groups are offset relative to each other in machine direction. They overlap in the cross machine direction.

In an embodiment, all of the separation areas are formed by a plain weave sequence of the warp yarn with at least three consecutive weft yarns.

According to one aspect, the first warp yarns form first separation areas, each of which being formed by a plain weave sequence with at least three consecutive weft yarns. The second warp yarns form second separation areas, each of which being formed by a plain weave sequence with maximum 15 consecutive weft yarns.

In an embodiment (see FIG. 3), a paper product includes a fibrous web manufactured in a paper making machine including a fabric, particularly a forming fabric or a drying fabric, the fibrous web having a first and an opposite second side, a machine direction (MD) and a cross-machine direction (CD), wherein at least one of the first and second sides of the web has in a pattern repeat, a number of longitudinal, machine direction oriented compressed areas with a first density of fibers and a number of machine direction oriented bulky areas with a second density of fibers lower than the first density, wherein the compressed areas correspond to machine direction oriented warp knuckles (21-31) of warp yarns (10) of the fabric floating over weft yarns (11) of the fabric, and the bulky areas correspond to valleys recessed relative to warp knuckles, wherein a continuous compressed pattern is formed by a plurality of compressed areas which are arranged directly adjacent in cross-machine direction wherein the pattern repeat includes in the machine direction a row of a plurality of third compressed areas including, for example, alternately first compressed areas and second compressed areas separated by a separation area, the first compressed areas having a first length in the machine direction and the second compressed areas having a second length in the machine direction, wherein the first length is smaller than the second length.

According to an aspect, the first and second warp knuckles may be separated by a third separation area, being formed by one of a plain weave sequence of the third warp yarn with at least three consecutive weft yarns and a float of the third warp yarn on the second side over one weft yarn.

In view of the above, it is to be emphasized that the compressed areas of the paper product correspond to the warp knuckles (elevated compression regions/areas) of the fabric, whereas valleys of the fabric correspond to bulky areas of the paper product. Further, all of the features above may randomly be combined.

Further embodiments will be apparent from the dependent claims as well as the following description of particular embodiments, which are described with reference to the accompanying drawings.

DESCRIPTION OF PARTICULAR EMBODIMENTS

Figure 1A:
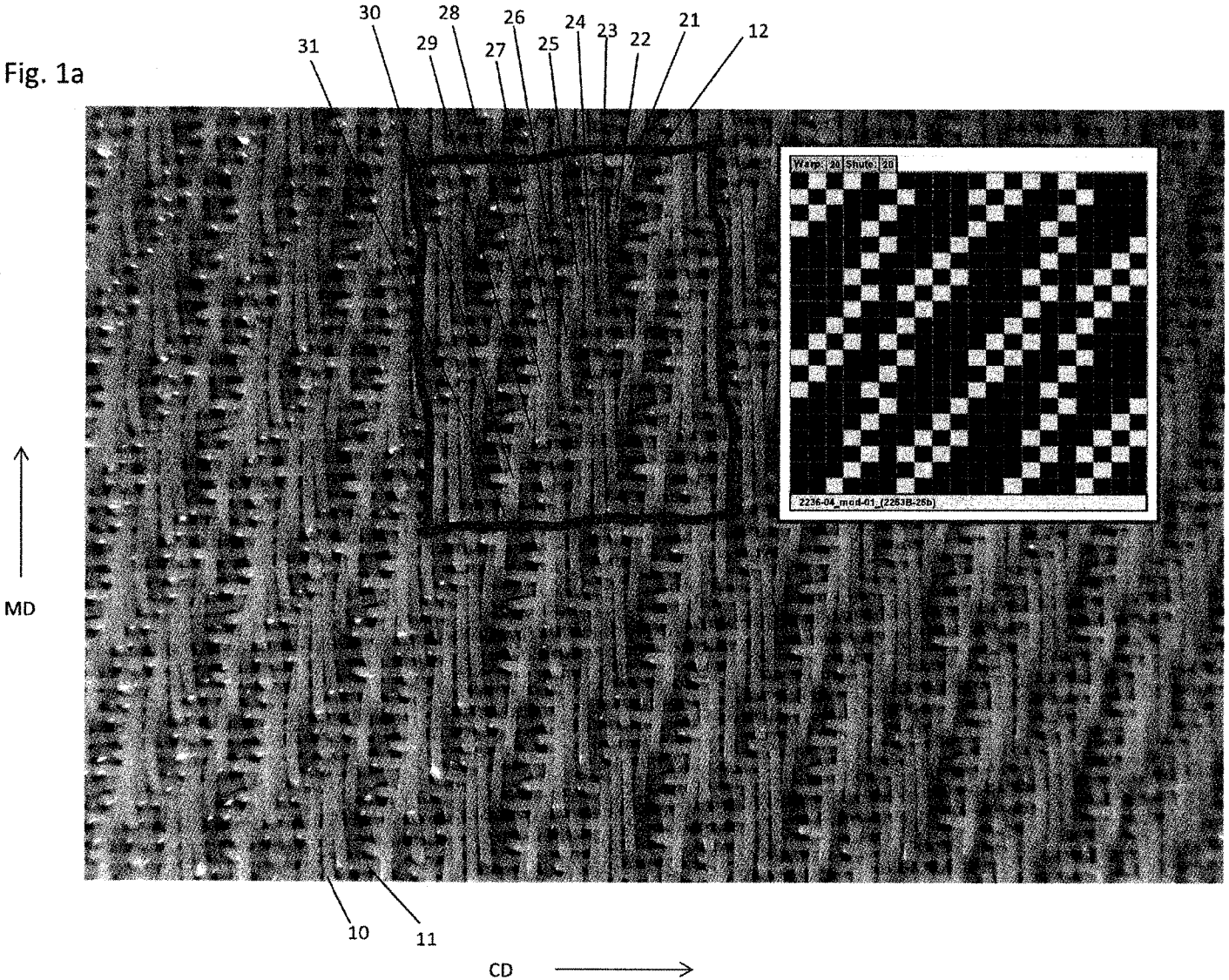
FIG. 1*a* shows a plan view of a portion of a forming fabric according to a first embodiment, wherein the pattern repeat has been indicated by a square.

The fabric, a portion of which is shown in FIG. 1*a* in a plan view may, according to an embodiment, be a through-air drying fabric. FIG. 1*a* shows the paper side of the fabric. The fabric is constituted by a plurality of parallel warp yarns 10 extending parallel to the machine direction MD and a plurality of weft yarns 11 substantially extending parallel to the cross-machine direction CD. The warp yarns 10 and the weft yarns 11 are interwoven, wherein warp yarns 10 alternatively float over weft yarns 11 in the machine direction and weft yarns 11 alternatively float over warp yarns 10 in the cross-machine direction. The fabric shown in FIG. 1*a* has a pattern repeat as indicated by the square 12.

The pattern repeat 12 includes a first group of warp knuckles 21 to 31. These warp knuckles 21 to 31, which float over a certain number of weft yarns 11 are formed by a plurality of directly adjacent warp yarns 10 with no other warp yarn 10 inbetween. Further, directly adjacent warp knuckles such as the warp knuckles 21 and 22 overlap as seen in a cross-machine direction CD. Furthermore, the plurality of warp knuckles 21 to 31 form a row in a direction diagonal to the machine direction MD and the cross-machine direction CD or, to put it differently, in an angle thereto.

Figure 1B:
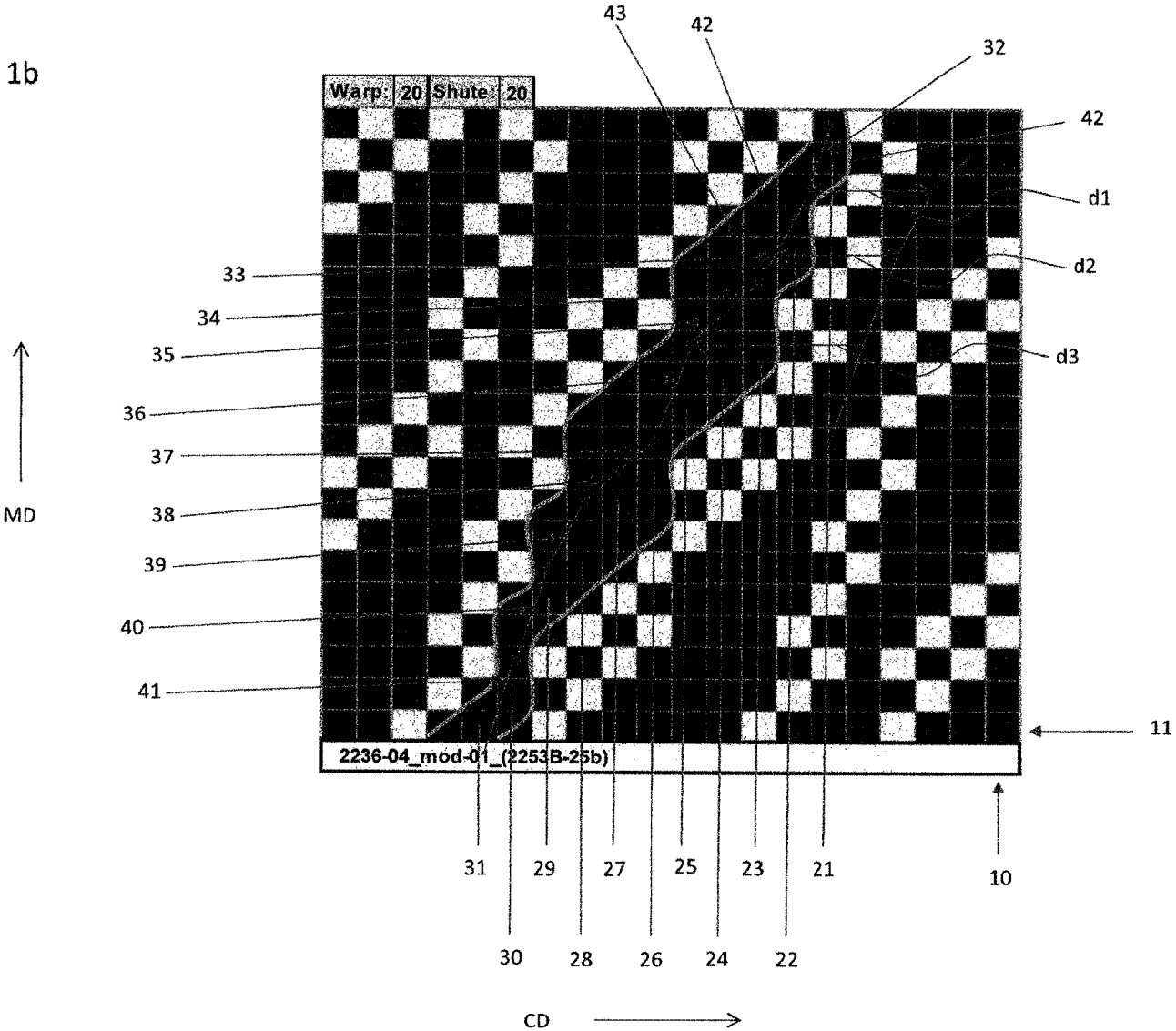
FIG. 1*b* shows a schematic pattern repeat in larger scale.

The pattern repeat is schematically shown on the right side of the rectangle 12, wherein each column represents one warp yarn and each line represents one weft yarn. The dark squares represent the warp yarns floating over the weft yarns and the light grey squares represent weft yarns floating over warp yarns. FIG. 1*b* shows this schematic representation of the pattern repeat in a larger scale.

The warp knuckle 21 has a float length of five floating over five weft yarns 11. The warp knuckle 22 has a float length of five as well. The warp knuckles 23 to 28 each have a float length of seven and the warp knuckles 29 to 31 again have a float length of five.

Connecting the center of the warp knuckles 21 and 22, which are directly adjacent to each other and form a first pair, one obtains a straight line 32. A second straight line 33 is defined by connecting the center of the warp knuckle 22 and the center of the warp knuckle 23. The warp knuckle 22 and the warp knuckle 23 form a second pair of directly adjacent warp knuckles. It is apparent that the lines 32 and 33 are angled relative to each other. The line 32 extends over four weft yarns, whereas the line 33 extends over only three weft yarns. Similar, the line 34 connecting the center of the warp knuckle 23 and the center of the warp knuckle 24 is differently angled than the line 32 and the line 33, extending over only two weft yarns. The line 34 connecting the center of the warp knuckle 24 and the center of the warp knuckle 25 extends over two weft yarns and is, therefore, angled at the same angle as line 34, i.e. the line 34 and the line 35 are parallel to each other. The line 36 connecting the center of the warp knuckle 25 and the warp knuckle 26 extends over four weft yarns and is, therefore, parallel to the line 32. The lines 37 and 38 connecting the warp knuckles 26 and 27 and 27 as well as 28, respectively, each extend over two weft yarns and are, therefore, parallel to the lines 34 and 35. The line 39 connecting the center of the warp knuckle 28 and the center of the warp knuckle 29 extends over three weft yarns and is, therefore, angled at the same angle as the line 33. The lines 40 and 41 which connect the centers of the warp knuckles 29 and 30 as well as 30 and 31, respectively, again extends over four weft yarns and is, therefore, angled at the same angle as the lines 32 and 36.

As a consequence, a line including all lines 32 to 41 is a non-straight line.

As is also visible from FIG. 1*b*, this configuration leads to a wavy outer contour 42 of the continuous pattern (continuous black area) formed by the directly adjacent warp knuckles 21 to 31.

This continuous pattern leads to a compressed area in the fibrous web manufactured by use of this fabric. Thereby, a compressed pattern, which is continuous over the entire surface of the fibrous web and, hence, the paper product may be achieved. Thus, the base tissue gives the product a distinct pattern without the need of further embossing or printing steps. In addition, the wavy or curved outer contour breaks up the strict geometrical perception and, therefore, enhances the soft and bulky appearance of the paper product.

At the same time and as compressed and bulky areas are still produced in the manufacturing process, the physical characteristics of the paper product are not deferred.

Also visible from FIG. 1*b* is a second to fifth group of directly adjacent warp knuckles forming a second to fifth continuous pattern. The line of these other groups of warp knuckles is congruent to the line constituted by connecting the lines 32 to 41. Yet, as visible, these lines are not parallel in that the distance d1 to d3 between the lines differs along the machine direction MD. For example, the distance d3 corresponds to five warp yarns, whereas the distance d1 corresponds to three and a half warp yarns only. This further disintegrates the strict geometrical structure and enhances the perception of a soft and bulky product. Yet, it is as well conceivable to arrange the lines between adjacent groups of directly adjacent warp knuckles forming adjacent continuous patterns or continuous compressed patterns in the product parallel to each other.

The warp knuckles of the groups have a float length of five or a float length of seven. Further and considering the light grey squares, the float length of the weft yarns is only one.

Hence, in this example, the float length of the first two adjacent knuckles such as 21 and 22 is the same as is the float length of the second two adjacent warp knuckles 23 and 24. However, the float length of the warp knuckles 22 and 23 is different.

In addition, the average float length of all warp knuckles of the pattern repeat forming the continuous pattern may be calculated as follows. There are four warp knuckles having a float length of five and six warp knuckles having a float length of seven. The pattern repeat is constituted by 20 warp and 20 weft yarns. This leads to an average float length of the warp knuckles constituting the continuous pattern of 6.2 within the pattern repeat.

In addition, at least 50% of the warp knuckles of the pattern repeat have a float length difference of not more than 10%, namely more than 50% of the warp knuckles in this embodiment have a float length of five or seven but not less.

Figure 2A:
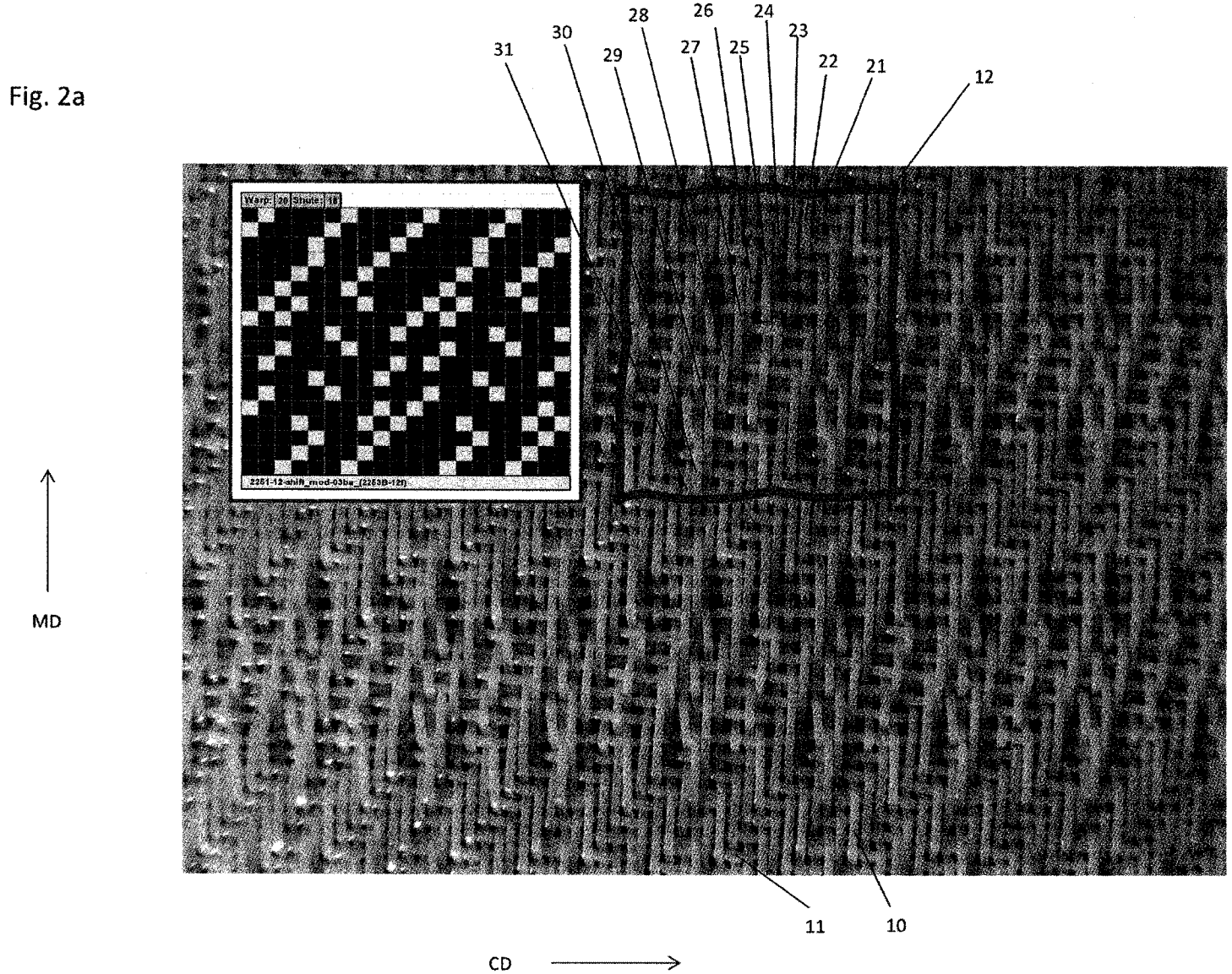
FIG. 2*a* shows a plan view of a portion of a forming fabric according to a second embodiment, wherein the pattern repeat has been indicated by a square.

FIG. 2*a* shows an alternative embodiment of a fabric. FIG. 2*a* as well shows the paper side of the fabric. The same reference numerals as in FIG. 1 have been used for the same or similar elements. The pattern repeat of this fabric has 20 warp yarns 10 and 18 weft yarns 11. The pattern repeat is indicated by the square 12.

A group of warp knuckles 21 to 31, which are directly adjacent to each other, forms a continuous pattern, that is a row of warp knuckles in a direction angled to the machine direction MD and the cross-machine direction CD as in the first embodiment above.

The warp knuckle 21 has a float length of four floating over four weft yarns 11. The warp knuckles 22 to 26 have a float length of five. The warp knuckles 27 to 29 each have a float length of seven. The warp knuckle 30 has float length of six and the warp knuckle 31 has a float length of four.

Connecting the center of the warp knuckles 21 and 22, which are directly adjacent to each other and form a first pair, one obtains a straight line 32. A second straight line 33 is defined by connecting the center of the warp knuckle 22 and the center of the warp knuckle 23. The warp knuckle 22 and the warp knuckle 23 form a second pair of directly adjacent warp knuckles. It is apparent that the lines 32 and 33 are angled relative to each other. The line 32 extends over two and a half weft yarns, whereas the line 33 extends over two weft yarns. Similar, the lines 34 connecting the center of the warp knuckle 23, 24 and 25, respectively, and the center of the warp knuckle 24, 25 and 26, respectively, are parallel to the line 33, extending over two weft yarns. The line 37 connecting the center of the warp knuckle 26 and the center of the warp knuckle 27 extends over three weft yarns and is, therefore, angled different than the line 32 and the lines 33 to 36. The lines 38, 39 connecting the center of the warp knuckle 27, 28 and the warp knuckle 28, 29 extend over four weft yarns. The line 40 connecting the warp knuckles 29 and 30 extend over three and a half weft yarns. The line 41 connecting the center of the warp knuckle 30 and the center of the warp knuckle 31 extends over three weft yarns.

As a consequence, a line including all lines 32 to 41 is a non-straight line.

Figure 2B:
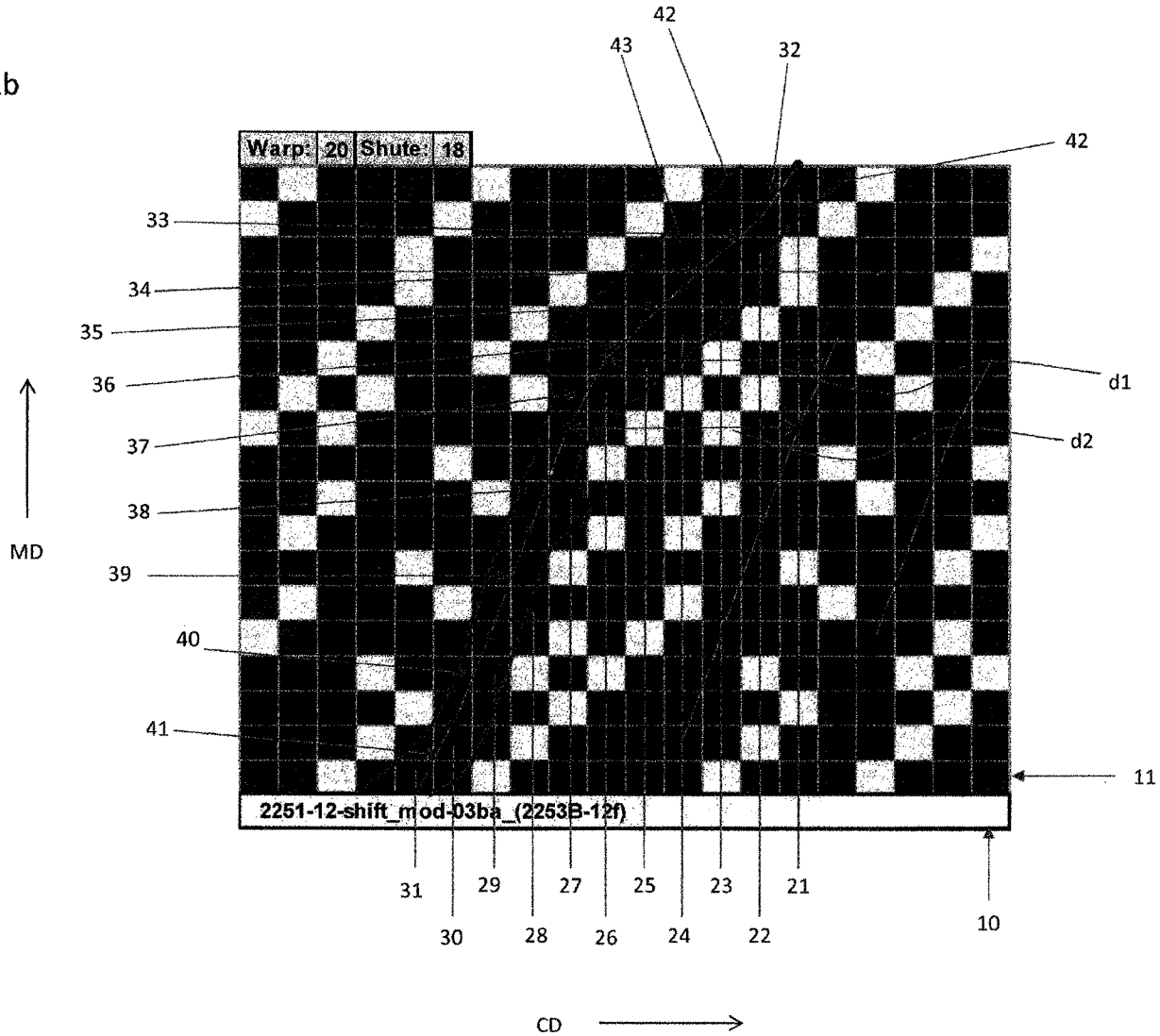
FIG. 2*b* shows the schematic pattern repeat in larger scale.

As is also visible from FIG. 2*b*, this configuration leads to a wavy outer contour 42 of the continuous pattern (continuous black area) formed by the directly adjacent warp knuckles 21 to 31 as described with respect to FIG. 1 above.

Also visible from FIG. 2*b* is a second to fifth group of directly adjacent warp knuckles forming a second to fifth continuous pattern. Directly adjacent groups have non-congruent lines. Rather, only the lines of every second group are congruent. The lines of every second group are also parallel to each other. Yet, the lines of directly adjacent groups are disposed so that a distance (e.g. d1 and d3) between the lines differs along the machine direction MD. For example, the distance d1 corresponds to approximately 5¾ warp yarns, whereas the distance d2 corresponds to six warp yarns. This further disintegrates the strict geometrical structure and enhances the perception of a soft and bulky product.

The warp knuckles of the groups have a float length of four, five, six or seven, respectively. Further and considering the light grey squares, the float length of the weft yarns is only one.

In addition, the average float length of all warp knuckles of the pattern repeat framing the continuous compressed pattern may be calculated as follows. There are five warp knuckles having a float length of five, three warp knuckles having a float length of seven, one warp knuckle having a float length of six and one warp knuckle having a float length of four. The pattern repeat is constituted by 20 warp and 18 weft yarns. This leads to an average float length of the warp knuckles constituting the continuous pattern of 5.6 within the pattern repeat.

It is evident that the two embodiments above are merely two examples of the present invention and are not intended to limit the scope of protection to either one of these examples. Rather, the scope of protection is defined in the following claims.

The invention claimed is:

1. A method for manufacturing a paper product, comprising:

providing a forming fabric or a drying fabric, the fabric having a plurality of machine direction oriented warp knuckles formed by warp yarns of the fabric floating over weft yarns of the fabric, wherein warp knuckles of directly adjacent warp yarns overlap in the cross-machine direction forming a continuous warp knuckle pattern angled to the machine and cross-machine directions, wherein a first line connecting the centers of first two directly adjacent warp knuckles of the continuous warp knuckle pattern is angled to the machine direction at a first angle different from a second angle of a second line connecting the centers of second two directly adjacent warp knuckles of the continuous warp knuckle pattern so that a line connecting the centers of all warp knuckles forming the continuous warp knuckle pattern is non-straight, and wherein at least 50% of all the directly adjacent warp knuckles have an overlap of at least three consecutive weft yarns; and forming or drying a fibrous web on the fabric.

2. The method according to claim 1, wherein the warp knuckles of the fabric forming the continuous pattern have a float length of at least 4.

3. The method according to claim 1, wherein the fabric has only weft knuckles with a float length of less than 4.

4. The method according to claim 1, wherein the float length of at least one of the first two adjacent warp knuckles or the second two adjacent warp knuckles is the same.

5. The method according to claim 1, wherein the average float length of all warp knuckles forming the continuous pattern in a pattern repeat is 4 to 8.

6. The method according to claim 1, wherein at least 50 percent of the warp knuckles of a pattern repeat forming the continuous compressed pattern have a float length difference of not more than 25 percent of the average float length of the warp knuckles forming the continuous compressed pattern in the pattern repeat.

7. A method of using a fabric in the manufacture of a paper product, comprising providing the fabric in a paper making machine, the fabric comprising a plurality of machine direction oriented warp knuckles formed by warp yarns of the fabric floating over weft yarns of the fabric, wherein warp knuckles of directly adjacent warp yarns overlap in the cross-machine direction forming a continuous warp knuckle pattern angled to the machine and cross-machine directions, wherein a first line connecting the centers of first two directly adjacent warp knuckles of the continuous warp knuckle pattern is angled to the machine direction at a first angle different from a second angle of a second line connecting the centers of second two directly adjacent warp knuckles of the continuous warp knuckle pattern so that a line connecting the centers of all warp knuckles forming the continuous warp knuckle pattern is non-straight, and wherein at least 50% of all the directly adjacent warp knuckles have an overlap of at least three consecutive weft yarns.

8. The method according to claim 7, wherein the warp knuckles of the fabric forming the continuous pattern have a float length of at least 4.

9. The method according to claim 7, wherein the fabric has only weft knuckles formed by the weft yarns of the fabric floating over the warp yarns with a float length of less than 4.

10. The method according to claim 7, wherein the float length of at least one of the first two directly adjacent warp knuckles or the second two directly adjacent warp knuckles is the same.

11. The method according to claim 7, wherein the average float length of all warp knuckles forming the continuous pattern in a pattern repeat is 4 to 8.

12. The method according to claim 7, wherein at least 50 percent of the warp knuckles forming the continuous compressed pattern have a float length difference of not more than 25 percent of the average float length of the warp knuckles forming the continuous compressed pattern in the pattern repeat.

* * * * *